US007525054B2

(12) United States Patent
Ng et al.

(10) Patent No.: US 7,525,054 B2
(45) Date of Patent: Apr. 28, 2009

(54) INTERLOCK DOOR SWITCH

(75) Inventors: Say Hwee Ng, Singapore (SG); Tian Cheng Tang, Singapore (SG)

(73) Assignee: Swann Industries Pte Ltd., Singapore (SG)

( * ) Notice: Subject to any disclaimer, the term of this patent is extended or adjusted under 35 U.S.C. 154(b) by 132 days.

(21) Appl. No.: 11/428,483

(22) Filed: Jul. 3, 2006

(65) Prior Publication Data

US 2008/0000760 A1 Jan. 3, 2008

(51) Int. Cl.
*H01H 3/30* (2006.01)

(52) U.S. Cl. ..... 200/10; 200/339

(58) Field of Classification Search ..... 200/43.11, 200/329, 339

See application file for complete search history.

(56) References Cited

U.S. PATENT DOCUMENTS

| | | | | |
|---|---|---|---|---|
| 3,701,870 | A * | 10/1972 | Sorenson | 200/295 |
| 4,115,673 | A * | 9/1978 | Smith | 200/315 |
| 4,345,121 | A * | 8/1982 | Tenner | 200/43.04 |
| 4,551,660 | A * | 11/1985 | Suzuki | 318/293 |
| 4,767,895 | A * | 8/1988 | Parrish | 200/43.04 |
| 4,772,768 | A * | 9/1988 | Nukada | 200/305 |
| 6,162,999 | A * | 12/2000 | Ishikawa et al. | 200/6 A |
| 6,175,090 | B1 * | 1/2001 | Blossfeld | 200/558 |
| 6,198,058 | B1 * | 3/2001 | Graninger et al. | 200/50.02 |
| 6,737,599 | B1 * | 5/2004 | Lewis | 200/557 |
| 6,767,255 | B1 * | 7/2004 | Croswell | 439/651 |
| 6,825,427 | B2 * | 11/2004 | Jenks | 200/51.12 |
| 6,919,523 | B1 * | 7/2005 | Lai | 200/402 |
| 6,974,918 | B2 * | 12/2005 | Blossfeld | 200/5 R |
| 7,009,128 | B1 * | 3/2006 | Czarnecki et al. | 200/339 |
| 7,026,565 | B1 * | 4/2006 | Lee | 200/339 |
| 7,052,298 | B1 * | 5/2006 | Cheng | 439/171 |
| 7,105,762 | B1 * | 9/2006 | Lee | 200/449 |
| 7,115,826 | B2 * | 10/2006 | Sasaki | 200/339 |
| 7,220,136 | B1 * | 5/2007 | Green | 439/106 |
| 2005/0082155 | A1 * | 4/2005 | Sasaki | 200/339 |
| 2007/0170047 | A1 * | 7/2007 | Ullermann | 200/339 |

FOREIGN PATENT DOCUMENTS

| | | | |
|---|---|---|---|
| DE | 3701870 | A1 * | 8/1988 |
| DE | 4115673 | A1 * | 11/1992 |
| DE | 4345121 | A1 * | 7/1995 |

* cited by examiner

*Primary Examiner*—Michael A Friedhofer
*Assistant Examiner*—Lisa N Klaus
(74) *Attorney, Agent, or Firm*—Conley Rose, P.C.

(57) ABSTRACT

A switch for switching between two electrical circuits is disclosed. The switch has a first connector that is electrically couplable to a first electrical circuit and a second connector that is electrically couplable to a second electrical circuit. The switch also has a first contact point adapted for electrically coupling the first connector to the first electrical circuit and a second contact point for electrically coupling the second connector to the second electrical circuit. The switch further includes an actuator for actuating the first and second connectors, wherein when the actuator is actuated to a first position, the first connector is electrically coupled to the first contact point while the second connector is electrically decoupled from the second contact point to thereby electrically close the first electrical circuit and electrically open the second electrical circuit, and when the actuator is actuated to a second position, the second connector is electrically coupled to the second contact point while the first connector is decoupled from the first contact point to thereby electrically close the second electrical circuit and electrically open the first electrical circuit.

17 Claims, 5 Drawing Sheets

INTERLOCK DOOR SWITCH

FIELD OF INVENTION

The invention relates generally to switches. In particular, the invention relates to an interlock switch for switching between two electrical circuits.

BACKGROUND

Switches are widely used for switching on and switching off electrical appliances. An example of such switches is an interlock switch. The interlock switch is commonly used for switching between two electrical circuits. For instance, a refrigerator usually has an interlock switch mounted to a frame defining a refrigerating chamber. The refrigerating chamber typically has a lamp for providing illumination when a door that is hinged mounted to the frame is opened. A fan used for circulating cold air in the refrigerating chamber is temporarily switched off when the door is opened. The lamp is then switched off in tandem with the fan being switched on again when the door is closed. This ensures that the circuit of one of two devices, for example, the lamp and the fan is electrically closed at any one time.

Interlock switches are commonly used in refrigerators for the purpose of providing an interlocking function for switching the lamp and the fan when the door is either opened or closed. Conventional interlock switches for this purpose typically consist of two pairs of electrically isolated conductive terminals. One of the two pairs of conductive terminals is used for providing electrical power to the lamp. The other pair of conductive terminals is used for providing electrical power to the fan. The two pairs of conductive terminals are therefore used for providing electrical power to either the lamp or the fan at any one time.

Operationally, conventional interlock switches use conductive blades for electrically connecting and disconnecting each pair of conductive terminals. Each conductive blade is typically actuable between pairs of conductive terminals. The conductive terminals and blades usually make contact at electrical contact points formed on the conductive terminals and blades. The conductive blades are typically arranged so that during actuation of the conventional interlock switches, only one pair of conductive terminals is electricity coupled for supplying electrical power to either the lamp or the fan.

The conductive terminals and blades of conventional interlock switches are usually positioned in proximity to one another. However, due to the close proximity between the conductive terminals and blades, any undesired positional deviation of each of the conductive terminals or blades may cause unwanted contact between the conductive terminals and blades. The presence of any foreign conductive object found within the conventional interlock switches may also result in undesirable electrical shorting between the conductive terminals and blades.

Other conventional interlock switches consisting of two pairs of conductive terminals that are typically used in electrical appliances for providing a safety feature for the electrical appliances. The safety feature usually requires full operability of the conventional interlock switches before electrical power is supplied for activating the electrical appliances. Therefore, if the conventional interlock switches malfunction during actuation, no electrical power is supplied to the electrical appliances.

However, electrically conductive carbon compound may be formed on the exterior of the conductive terminals, blades or electrical contact points of the conventional interlock switches because of prolonged use. This may result in undesirable electrical shorting between the conductive terminals and blades, especially when the electrical contact points of the conductive terminals and blades are positioned intimately to each other.

There is therefore a need for an interlock switch that is able to eliminate unintended contacts between conductive components thereof for improving the reliability of the interlock switch.

SUMMARY

Embodiments of the invention disclosed herein provide improved reliability of a switch by reducing unnecessary contacts between conductive components therein.

Therefore, in accordance with an embodiment of the invention, a switch for switching between two electrical circuits is disclosed. The switch comprises a first contact and a first conductor engageable to and disengageable from the first contact for respectively electrically closing and electrically opening a first electrical circuit electrically associable therewith. The switch also comprises a second contact and a second conductor engageable to and disengageable from the second contact for respectively electrically closing and electrically opening a second electrical circuit electrically associable therewith, the first conductor being substantially electrically isolated from the second conductor. The switch further comprises an actuator adapted for receiving the first conductor and the second conductor and whereto each of the first conductor and the second conductor is movably coupled, the actuator is positionable to a first position for engaging the first conductor to the first contact and disengaging the second conductor from the second contact and positionable to a second position for disengaging the first conductor from the first contact and engaging the second conductor to the second contact. In particular, the actuator is shaped and dimensioned and is configured with each of the first conductor and the second conductor for substantially impeding engagement of the first conductor with the first contact when the second conductor is engaged to the second contact and for substantially impeding engagement of the second conductor with the second contact when the first conductor is engaged to the first contact. This is so that simultaneous electrical closing of the first electrical circuit and electrical closing of the second electrical circuit is substantially prevented.

BRIEF DESCRIPTION OF THE DRAWINGS

Embodiments of the invention are described hereinafter with reference to the drawings, in which.

DETAILED DESCRIPTION

Figure 1:
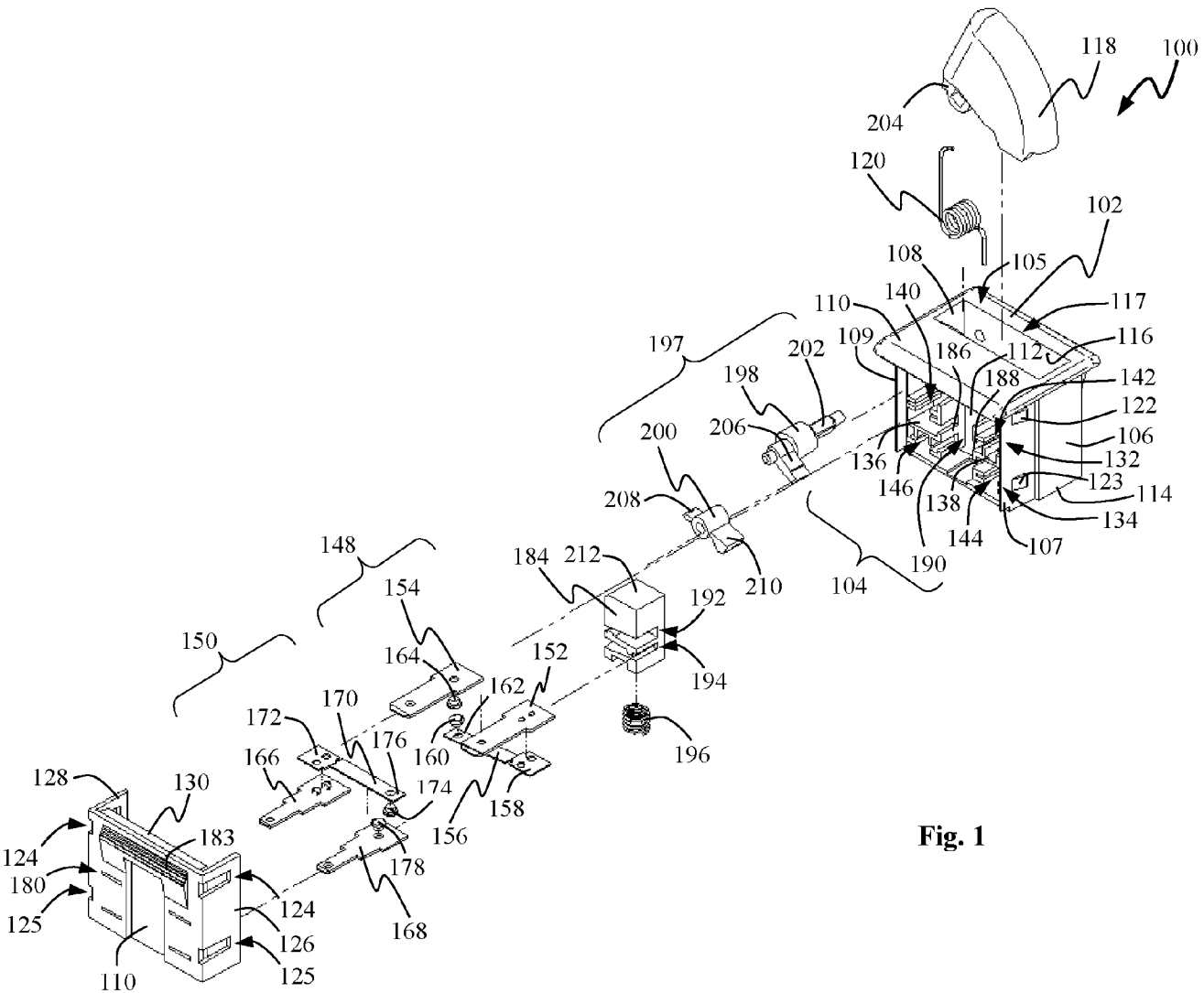
FIG. 1 is an exploded view of a switch according to an embodiment of the invention.

With reference to the drawings, embodiments of the invention for eliminating unnecessary contacts between conductive components thereof are disclosed. The switch is suitable for providing an interlocking function.

Conventional switches for providing an interlocking function usually consist of conductive components that are arranged in proximity to each other. The close proximity of the conductive components allows the switch to be dimensionally compact for easy integration with electrical appliances. However, any undesired positional deviations of conductive components or growth of electrically conductive carbon compound on the conductive components increases the possibility of electrical shorting between the conductive components. Conventional switches are therefore in need for eliminating unintended contacts between conductive components thereof for providing a reliable interlocking function.

For purposes of brevity and clarity, the description of the invention is limited hereinafter to applications related to switches for providing an interlocking function. This however does not preclude embodiments of the invention from other areas of application that requires a reliable interlocking function. The functional and operational principles upon which embodiments of the invention are based remain the same throughout the various embodiments.

Embodiments of the invention are described in greater detail hereinafter in accordance to illustrations provided in FIGS. 1 to 5A and 5B of the drawings, wherein like elements are identified with like reference numerals.

With reference to FIG. 1, an exploded view of a switch 100 according to a first embodiment of the invention is shown. The switch 100 has an enclosure 102 that includes a first housing portion 104 and a second housing portion 105. The enclosure 102 comprises a pair of parallel and opposing sidewalls 106, 108. The pair of sidewalls 106, 108 is preferably joined substantially perpendicularly to a top wall 110 and a bottom wall 114. Two spaced-apart parallel walls including a center wall 112 and a rear wall 116 preferably extend substantially perpendicularly between the pair of sidewalls 106, 108 and the top and bottom walls 110, 114. The center wall 112 provides separation of the first housing portion 104 and the second housing portion 105.

The top wall 110 preferably has an opening 117 for receiving a torsion spring 120 and a button 118 therethrough. The torsion spring 120 and the button 118 are housed in the second housing portion 105. The torsion spring 120 is positioned within the button 118 and adapted for resiliently biasing the button 118. Each of the pair of sidewalls 106, 108 further includes a flange portion 107, 109. A pair of protrusions or latches 122, 123 is preferably formed on each of the flange portions 107, 109 and is adapted for latching to a corresponding pair of grooves 124, 125 formed on each side portions 126, 128 of a cover 130. The pair of latches 122, 123 and the corresponding pair of grooves 124, 125 are therefore used for coupling the enclosure 102 and the cover 130.

The first housing portion 104 further consists of an upper compartment 132 and a lower compartment 134. A pair of inter-displaced barrier walls, including a first barrier wall 136 and a second barrier wall 138 separates the upper and lower compartments 132, 134. The first and second barriers walls 136, 138 are preferably formed on different tiers and are extended substantially perpendicularly from the center wall 112 towards the cover 130. The second barrier wall 138 is preferably displaced further away from the bottom wall 114 than the first barrier wall 136. The upper compartment 132 has a first upper terminal slot 140 and a second upper terminal slot 142. The first upper terminal slot 140 and the second upper terminal slot 142 are preferably formed on a same tier. The lower compartment 134 has a first lower terminal slot 144 and a second lower terminal slot 146, which are formed on a same tier. The first and second lower terminal slots 144, 146 are preferably displaced closer to the bottom wall 114 than the first and second upper terminal slots 140, 142. The first and second upper terminal slots 140, 142 are adapted for receiving an upper terminal assembly 148 while the first and second lower terminal slots 144, 146 are adapted for receiving a lower terminal assembly 150.

The upper terminal assembly 148 consists of a first upper terminal 152, a second upper terminal 154 and an upper conductor or blade 156. The upper blade 156 is preferably a first metallic strip that is canted. A compact riveting process, as known in the art, is preferably used for coupling one end portion 158 of the upper blade 156 securely to the first upper terminal 152. A first upper contact 160 is preferably coupled to the other end 162 of the upper blade 156. A second upper contact 164 is preferably coupled to the second upper terminal 154 such that when the upper blade 156 is flexed, the first and second upper contacts 160, 164 are capable of engaging each other.

The lower terminal assembly 150 is preferably a reciprocal arrangement of the upper terminal assembly 148 and consists of a first lower terminal 166, a second lower terminal 168 and a lower conductor or blade 170. The lower blade 170 is preferably a second metallic strip that is canted. The compact riveting process, used for coupling the upper blade 156 to the first upper terminal 152, is preferably used for coupling one end portion 172 of the lower blade 170 securely to the first lower terminal 166. A first lower contact 174 is preferably coupled to the other end 176 of the lower blade 170. A second lower contact 178 is preferably coupled to the second lower terminal 168 such that when the lower blade 170 is flexed, the first and second lower contacts 174, 178 are capable of engaging each other.

The first and second upper slots 140, 142 are configured for receiving the first and second upper terminals 152, 154 respectively while the first and second lower slots 144, 146 are configured for receiving the first and second lower terminals 166, 168 respectively. Each of the first and second upper terminals 152, 154 and the first and second lower terminals 166, 168 is substantially perpendicular to the center wall 112 and is substantially parallel to the first and second barrier walls 136, 138 when received by a corresponding upper 140, 142 or lower 144, 146 terminal slots. Apertures 180 are formed in a front portion 182 of the cover 130 and are adapted for receiving the upper 152, 154 or lower 168, 166 terminals therethrough. The front portion 182 further has a catch 183 for mounting the switch 100 to a rigid structure, such as a doorframe.

The switch 100 also has an actuator 184. A pair of spatially displaced guiding walls 186, 188 extends substantially perpendicularly from the center wall 112 and is preferably joined to the first and second barriers walls 136, 138. The pair of guiding walls 186, 188 is preferably parallel to the pair of sidewalls 106, 108 and defines a space 190 along which the actuator 184 is able to displace. The actuator 184 preferably has upper and lower slots 192, 194 separated by a predetermined distance. The upper and lower slots 192, 194 are preferably adapted for receiving the upper and lower blades 156, 170 respectively. The actuator 184 is preferably resiliently biased. The biasing of the actuator 184 is provided by a compression spring 196 positioned in between the bottom wall 114 and one end of the actuator 184 adjacent to the bottom wall 114. The bottom wall 114 and the actuator 184 are preferably adapted for receiving the compression spring 196.

The switch further consists of a rotary assembly 197. The rotary assembly 197 includes a rotor 198 and a lever 200. The rotor 198 has a shaft 202 that is shaped to form an integrated key (not shown) to impede relative rotational displacement between the rotor 198 and the button 118 when the shaft 202 is received within a receiving portion 204 of the button 118. The rotor 198 also has an arm 206 for engaging a first arm 208 of the lever 200. The lever 200 has a second arm 210 for engaging a top portion 212 of the actuator 184. The rotor 198 and the lever 200 are cooperatively used in conjunction with the torsion spring 120 and the button 118 for actuating the actuator 184 within the space 190.

Figure 2B:
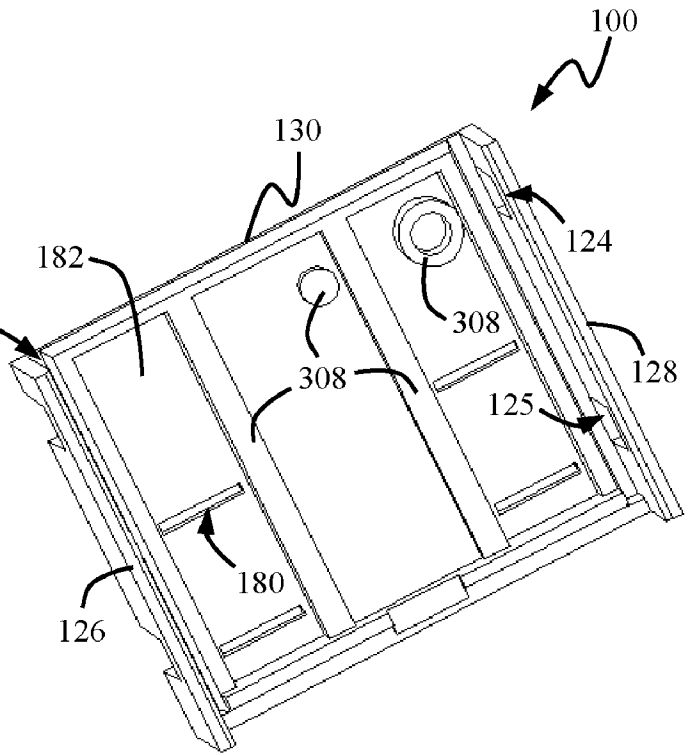
FIG. 2B is an isometric view of a cover of the switch of FIG. 1.
Figure 2A:
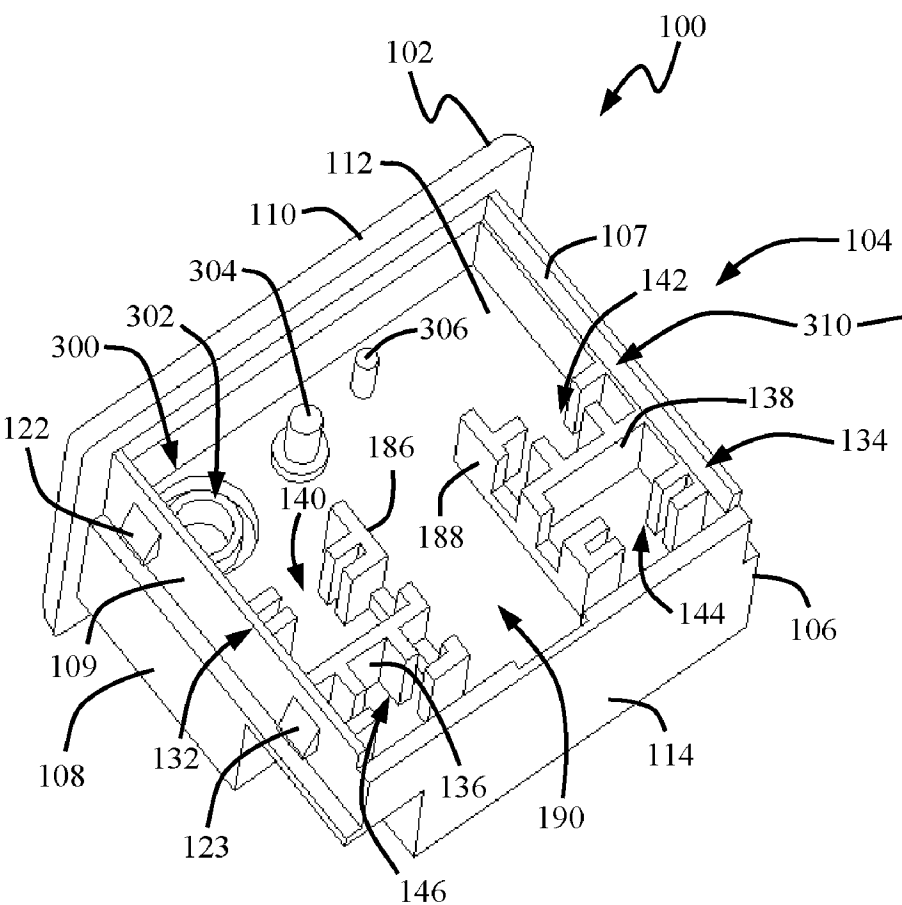
FIG. 2A is an isometric view of an enclosure of the switch of FIG. 1.

FIGS. 2A and 2B show isometric views of the enclosure 102 and cover 130 respectively. With reference to FIG. 2A, the enclosure 102 has a hub 300 formed on the center wall 112. The hub 300 is preferably adapted for receiving the rotor 198 and is disposed substantially adjacent to the flanged portion 109 and the top wall 110. The hub 300 has a hole 302 through which the shaft 202 of the rotor 198 passes for engaging the receiving portion 204 of the button 118. The enclosure 102 further includes a post 304 and a pin 306. Each of the post 304 and pin 306 extends substantially perpendicularly from the center wall 112. The post 304 is configured for receiving the lever 200 while the pin 306 is positioned for stopping the second arm 210 of the lever 200 from rotating towards the top wall 110.

As shown in FIG. 2B, the cover 130 preferably has abutting structures 308 formed on one side of the front portion 182. The abutting structures 308 are used for abutting one end of the pair of guiding walls 186, 188, the rotor 198 and the lever 200 when the cover 130 is coupled to the enclosure 102.

With reference to FIGS. 2A and 2B, each of the enclosure 102 and cover 130 further has mating surfaces 310. The mating surfaces 310 of the enclosure 102 and cover 130 are preferably reciprocally tapered and adapted for preventing ingress of water into the first housing portion 104 of the switch 100 when the cover 130 is coupled to the enclosure 102. Silicone is preferably used for sealing the apertures 180 of the cover 130 after the switch 100 is assembled.

Figure 3:
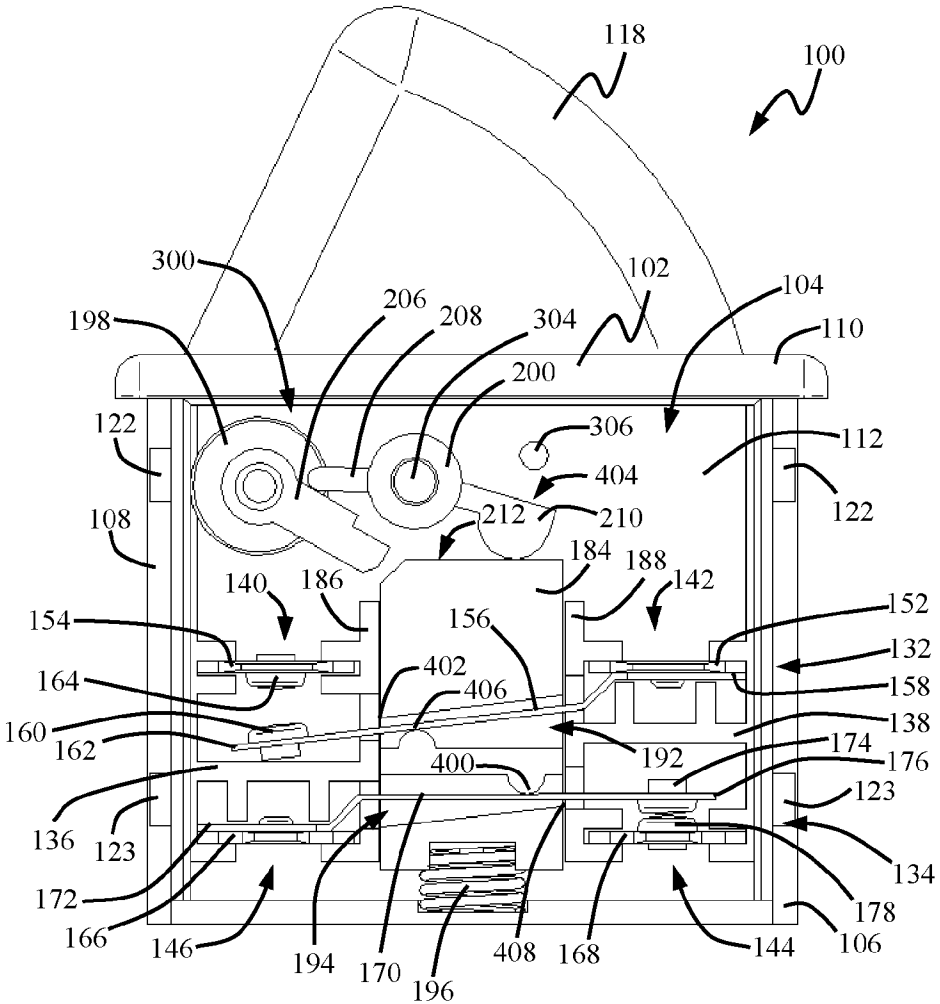
FIG. 3 is a plan view of the switch of FIG. 1 actuated to a first position according to the embodiment of the invention.

FIG. 3 shows a front view of the switch 100 being assembled without the cover 130. The arrangement of the first and second barrier walls 136, 138 and the actuator 184 advantageously prevent accidental electrical shorting of the upper and lower terminal assemblies 148, 150. Additionally, the arrangement of the first and second barrier walls 136, 138 and the actuator 184 minimizes the risk of electrical shorting due to an accumulation of electrically conductive carbon compound formed on the upper and lower assemblies 148, 150.

FIG. 3 further shows the rotor 198 and lever 200 being rotatably coupled to the hub 300 and post 304 respectively while the actuator 184 is actuated to a default or first position. At this first position, the button 118 is not actuated while the actuator 184 is being fully depressed towards the bottom wall 114 of the enclosure 102 by a spring force. The spring force is provided by the torsion spring 120 and is transmitted to the actuator 184 through the rotor assembly 197. The spring force causes the arm 206 of the rotor 198 to displace the first arm 208 of the lever 200 towards the top wall 110 of the enclosure 102. This in turn displaces the second arm 210 of the lever 200 towards the top portion 212 of the actuator 184. The second arm 210 of the lever 200 then depresses the actuator 184 towards the lower wall 114 and thereby compresses the compression spring 196. This results in the arrival of the first position of the actuator 184.

The upper and lower terminal assemblies 148, 150 are preferably in a reciprocated configuration. This means that the pair of first and second upper contacts 160, 164 and the pair of first and second lower contacts 174, 178 are preferably arranged on opposite sides of the actuator 184. This advantageously allows the switch 100 to have a compact design. In this reciprocated configuration of the upper and lower terminal assemblies 148, 150, the lower terminal assembly 150 is capable of conducting electricity when the actuator 184 is actuated to the first position. At the first position of the actuator 184 as shown in FIG. 3, the lower terminal assembly 150 is "closed" while the upper terminal assembly 148 is "opened". More specifically, the first and second lower contacts 174, 178 are coupled during which the first and second upper contacts 160, 164 are decoupled. The lower blade 170 of the lower assembly 150 is abutted at a first lower actuation point 400 of the actuator 184. The first lower actuation point 400 pushes the lower blade 156 towards the bottom wall 114 for the first lower contact 174 to couple the second lower contact 170. A first upper actuation point 402 of the actuator 184 ensures that the first and second upper contacts 160, 164 are decoupled when the first and second lower contacts 174, 178 are coupled.

Figure 4:
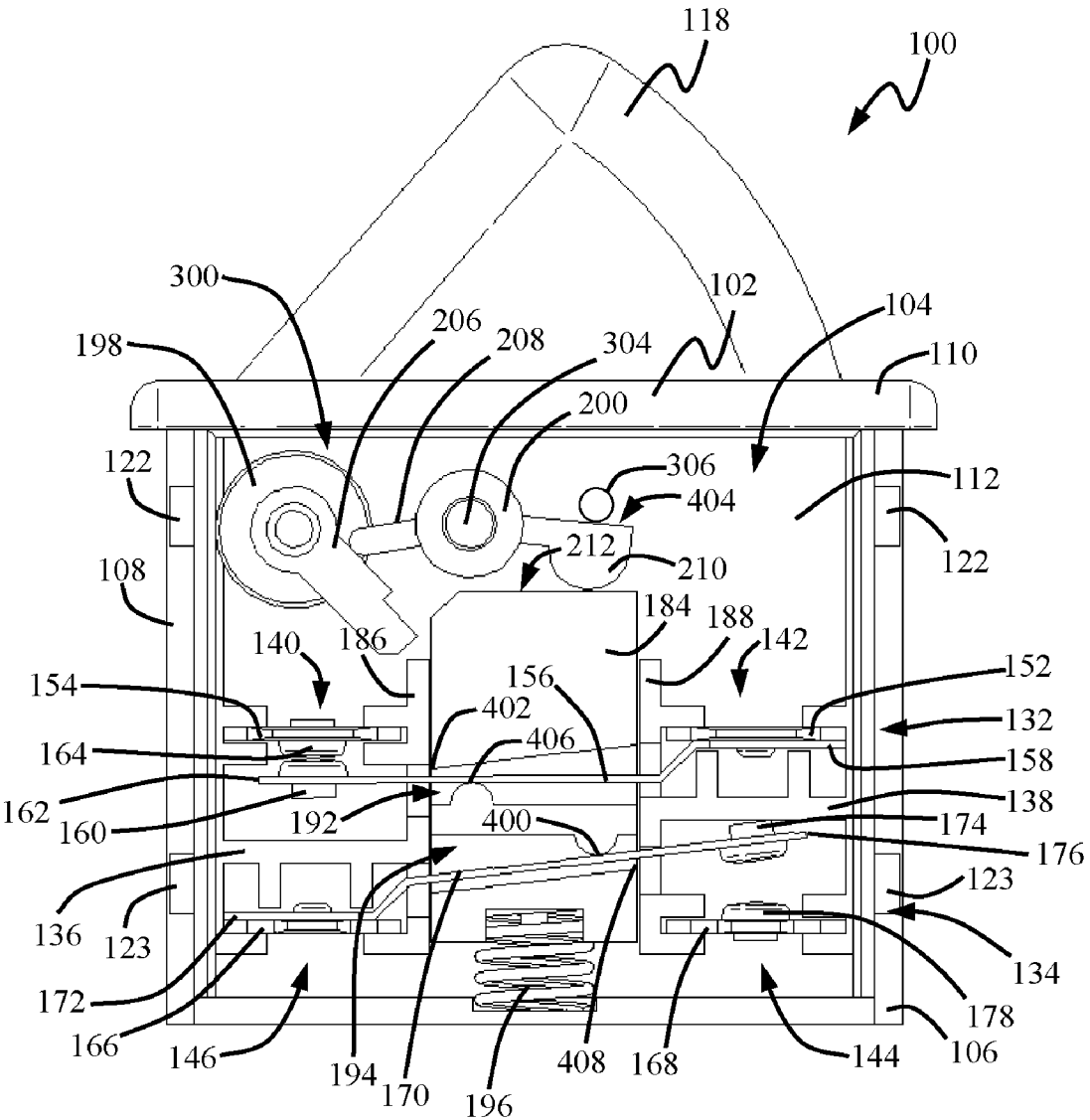
FIG. 4 is a plan view of the switch of FIG. 1 actuated to a second position according to the embodiment of the invention.

When the button 118 is depressed as shown in FIG. 4, conversely to the first position of the actuator 184 as described previously, the spring force from the torsion spring 120 is removed. This allows the compression spring 196 to decompress and bias the actuator 184 towards the top wall 110. The top portion 212 of the actuator 184 then displaces the second arm 210 of the lever 200 towards the top wall 110 until the first and second upper contacts 160, 164 are coupled. The second arm 210 of the lever 200 preferably has a flat surface 404 for abutting the pin 306. The position of the pin 306 therefore defines a second position of the actuator 184. At the second position of the actuator 184, the upper terminal assembly 148 is "closed" for conducting electricity therethrough while the lower terminal assembly is "opened" for breaking an electrical current flowing therethrough. A second upper actuation point 406 pushes the upper blade 156 towards the top wall 110 for coupling the first upper contact 160 and the second upper contact 164. A second lower actuation point 408 of the actuator ensures that the first and second lower contacts 174, 178 are decoupled when the first and second upper contacts 160, 164 are coupled.

The pair of upper actuation points 402, 406 and the pair of lower actuation points 400, 408 are preferably located at one end of the upper and lower slots 192, 194 of the actuator 184 respectively. Additionally, the pair of upper actuation points 402, 406 and the pair of lower actuation points 400, 408 are preferably substantially distal to the end portions 158, 172 of the upper and lower blades 156, 170 respectively. The upper and lower slots 192, 194 are preferably wedge shaped such that the pair of upper actuation points 402, 406 and the pair of lower actuation points 400, 408 are located at narrower ends of the upper and lower slots 192, 194 respectively. This advantageously accommodates change in angular tilt of the first and second blades 156, 170 when the actuator 184 is displaced between the first and second positions.

Figure 5B:
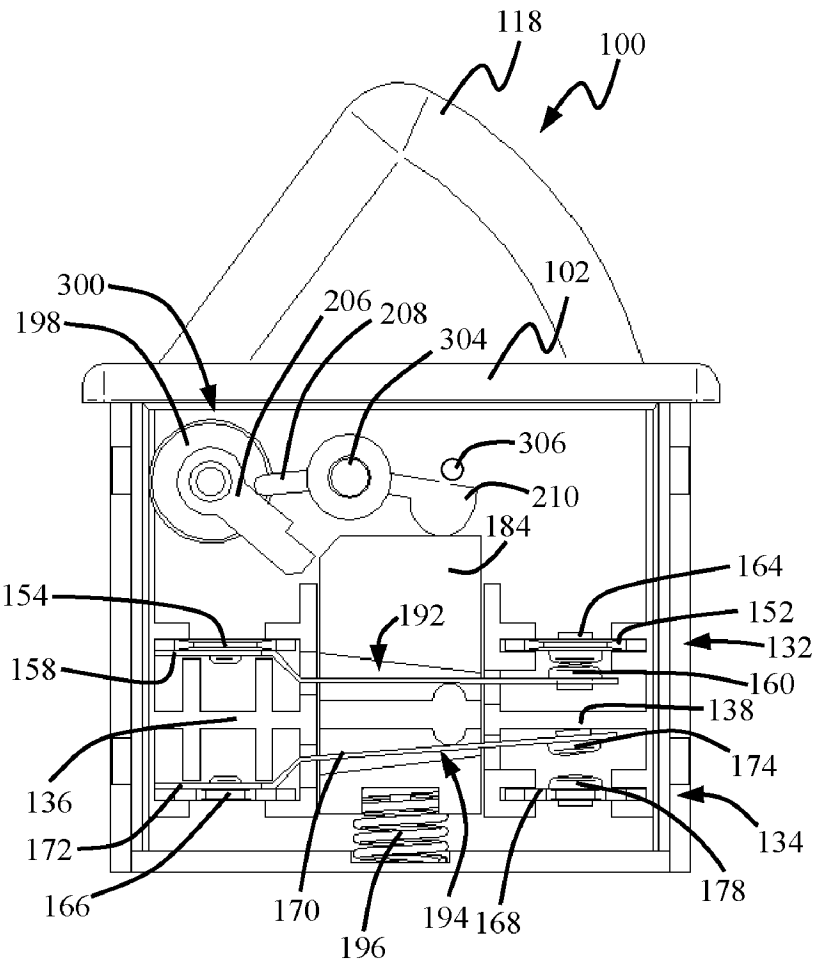
FIG. 5B is a plan view of the switch of FIG. 1 actuated to a second position according to another embodiment of the invention.
Figure 5A:
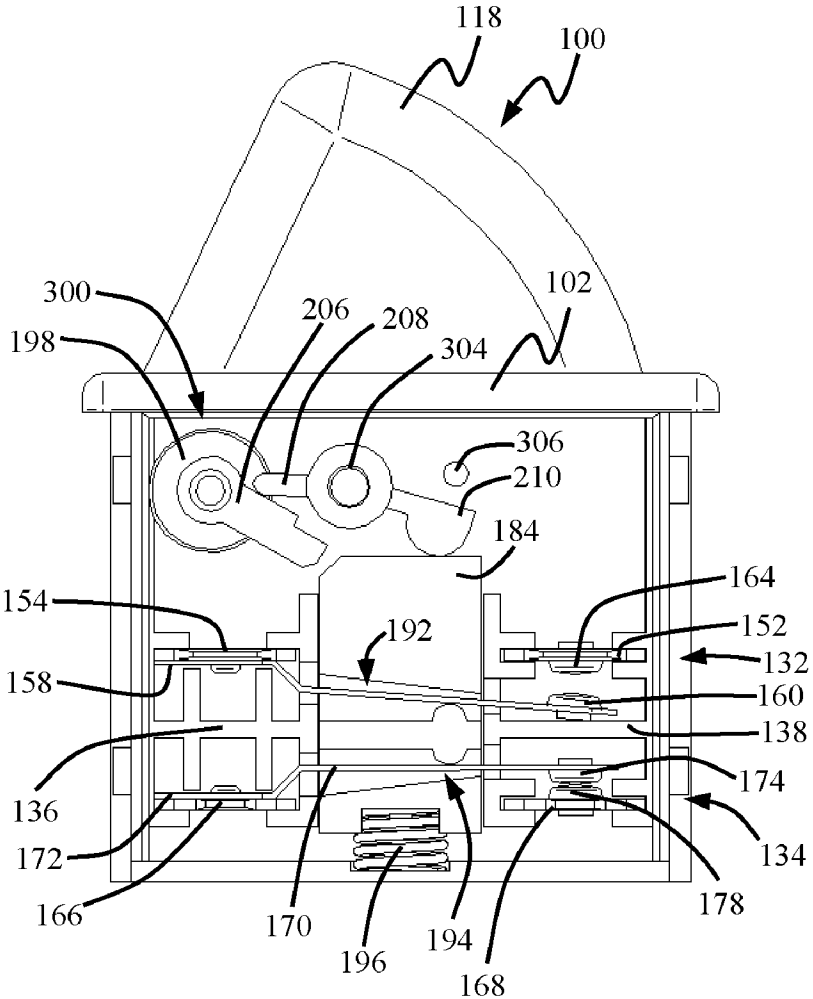
FIG. 5A is a plan view of the switch of FIG. 1 actuated to a first position according to another embodiment of the invention.

FIGS. 5A and 5B show a second embodiment of the invention wherein the upper and lower terminal assemblies 148, 150 are in a mirrored configuration. FIG. 5A shows the actuator 184 to be in the first position while FIG. 5B shows the actuator 184 to be in a second position. In this mirrored configuration of the upper and lower terminal assemblies 148, 150, the pair of first and second upper contacts 160, 164 and the pair of first and second lower contacts 174, 178 are located on a same side of the actuator 184. The first and second barriers walls 136, 138 are preferably formed on a same tier while the narrower ends of the upper and lower slots 192, 194 are formed on a same side portion of the actuator 184.

The actuator 184 together with the reciprocated or mirrored configuration of the upper and lower terminal assemblies 148, 150 therefore provide the switch 100 with an interlocking function. The interlocking function allows switching of two electrical circuits that are electrically connected to the switch 100. The reciprocated or mirrored configuration of the upper and lower terminal assemblies 148, 150 further provides a safety feature for the switch 100. This safety feature ensures that when one of the pairs of upper 160, 164 or lower 174, 178 contacts is welded due to excessive electrical current flowing therethrough, the other of the upper 160, 164 or lower 174, 178 contacts is prevented from coupling each other.

The design of the actuator 184 and the configuration of the upper and lower terminal assemblies 148, 150 advantageously require a minimal force for actuating the upper and lower blades 156, 170. This is because the actuator 184 is additionally pushed by the upper or lower blade 156, 170 when actuated between the first position and second positions as the upper or lower blade 156, 170 returns to a neutral position.

In the foregoing manner, a switch for switching two electrical circuits and for providing an interlocking function is disclosed. Although only a few embodiments of the invention are disclosed, it becomes apparent to one skilled in the art in view of this disclosure that numerous changes and/or modification can be made without departing from the scope and spirit of the invention

What is claimed is:

1. A switch for switching between two electrical circuits, the switch comprising:

a first contact;

a first conductor engageable to and disengageable from the first contact for respectively electrically closing and electrically opening a first electrical circuit electrically associable therewith;

a second contact;

a second conductor engageable to and disengageable from the second contact for respectively electrically closing and electrically opening a second electrical circuit electrically associable therewith, the first conductor being substantially electrically isolated from the second conductor; and an actuator adapted for receiving the first conductor and the second conductor and whereto each of the first conductor and the second conductor is movably coupled, the actuator is positionable to a first position for engaging the first conductor to the first contact and disengaging the second conductor from the second contact and positionable to a second position for disengaging the first conductor from the first contact and engaging the second conductor to the second contact, wherein the actuator is shaped and dimensioned and is configured with each of the first conductor and the second conductor for substantially impeding engagement of the first conductor with the first contact when the second conductor is engaged to the second contact and for substantially impeding engagement of the second conductor with the second contact when the first conductor is engaged to the first contact, whereby simultaneous electrical closing of the first electrical circuit and electrical closing of the second electrical circuit is substantially prevented.

2. The switch of claim 1, wherein a first wall and a second wall are formed between the first and second connectors.

3. The switch of claim 2, wherein the actuator is disposed between the first wall and the second wall.

4. The switch of claim 2, wherein each of the first wall and the second wall is substantially perpendicular to the actuator.

5. The switch of claim 2, wherein each of the first wall and the second wall is formed on a different tier.

6. The switch of claim 1, wherein the actuator is resiliently biased.

7. The switch of claim 1, wherein the actuator has a first slot and a second slot for receiving the first conductor and the second conductor respectively.

8. The switch of claim 7, wherein each of the first slot and the second slot is substantially wedge shaped.

9. The switch of claim 7, wherein each of the first slot and the second slot has a narrower end for abutting the first conductor and the second conductor respectively.

10. The switch of claim 1, wherein the actuator is disposed between a first guiding wall and a second guiding wall.

11. The switch of claim 10, wherein the first guiding wall and the second guiding wall are arranged for providing a space in which the actuator actuates between the first position and the second position.

12. The switch of claim 1, further comprising a first spring being used in conjunction with a rotary assembly for actuating the actuator, the rotary assembly comprising a rotor and a lever, wherein the rotor is adapted for engaging the first spring and the lever.

13. The switch of claim 12, wherein the lever is adapted for engaging the actuator and a pin, wherein the pin is used for defining a second position of the actuator.

14. The switch of claim 13, further comprising a button adapted for rotationally displacing the rotor.

15. The switch of claim 14, further comprising a second spring for providing a second spring force for biasing the actuator towards the second position and for displacing the actuator to the second position when the rotor is rotationally displaced.

16. The switch of claim 1, further comprising a first upper terminal and a second upper terminal, wherein the first upper terminal is coupled to one end of the first conductor and the second upper terminal is engagable to the other end of the first conductor.

17. The switch of claim 1, further comprising a first lower terminal and a second lower terminal, wherein the first lower terminal is coupled to one end of the second conductor and the second lower terminal is engagable to the other end of the second conductor.

* * * * *